US008784224B1

(12) United States Patent
Schafer

(10) Patent No.: US 8,784,224 B1
(45) Date of Patent: Jul. 22, 2014

(54) MOBILE, MODULAR WATER AMUSEMENT RIDE

(76) Inventor: Brian E. Schafer, Troutman, NC (US)

( * ) Notice: Subject to any disclaimer, the term of this patent is extended or adjusted under 35 U.S.C. 154(b) by 71 days.

(21) Appl. No.: 13/602,902

(22) Filed: Sep. 4, 2012

(51) Int. Cl.
*A63G 21/18* (2006.01)
*A63G 31/00* (2006.01)

(52) U.S. Cl.
USPC ..... 472/117; 472/13; 472/116

(58) Field of Classification Search
USPC ..... 472/3, 116, 117, 128, 129; 104/55, 69, 104/70
See application file for complete search history.

(56) References Cited

U.S. PATENT DOCUMENTS 4,196,900 A * 4/1980 Becker et al. ..... 472/117
4,299,171 A * 11/1981 Larson ..... 104/70
5,011,134 A * 4/1991 Langford ..... 472/117
5,503,597 A 4/1996 Lochtefeld et al.
5,507,696 A 4/1996 Smollar et al.
5,577,945 A 11/1996 LaBelle
5,820,472 A 10/1998 Briggs
6,527,646 B1 * 3/2003 Briggs ..... 472/117
6,743,107 B2 * 6/2004 Dubeta ..... 472/116
7,682,259 B1 3/2010 Edwards
7,951,011 B2 * 5/2011 Lochtefeld ..... 472/117
2003/0196580 A1 10/2003 Broderick et al.
2009/0176588 A1 7/2009 Lochtefeld

* cited by examiner

*Primary Examiner* — Kien Nguyen

(74) *Attorney, Agent, or Firm* — P. Jeff Martin; The Law Firm of P. Jeffrey Martin, LLC

(57) ABSTRACT

A modular water slide apparatus integrated with a transportable unit includes a major slide structure, a minor slide structure, a plurality of water jet nozzles, a trailer, a water supply and storage tank, a water catch basin, a plurality of anchor columns, and at least one circular, spiral, or winding staircase.

20 Claims, 6 Drawing Sheets

MOBILE, MODULAR WATER AMUSEMENT RIDE

RELATED APPLICATIONS

This application claims priority to U.S. Provisional Patent Application Ser. No. 61/531,834, filed on Sep. 7, 2011 and entitled, "Mobile, Modular Water Amusement Ride". The entire contents of which are herein incorporated by reference.

BACKGROUND OF THE INVENTION

1. Field of the Invention

The present invention relates generally to amusement rides and, more particularly, to a mobile, modular water slide apparatus.

2. Description of the Related Art

Currently there exist in the art various water recreation rides, devices, slides, and apparatuses. However, the prior art has failed to disclose or teach a modular water slide apparatus constructed onto a mobile or transportable unit as disclosed by the present application.

Accordingly, a need exists for a modular water slide apparatus integrated with a mobile or transportable unit. The development of the mobile, modular water slide apparatus fulfills this need.

A search of the prior art did not disclose any patents that read directly on the claims of the instant invention; however, the following references were considered related:

U.S. Patent Application no. 2009/0176588 A1, published in the name of Lochtefeld;

U.S. Pat. No. 7,682,259 B1, published in the name of Edwards;

U.S. Pat. No. 5,577,945, issued in the name of LaBelle;

U.S. Pat. No. 5,507,696, issued in the name of Smoller et al.;

U.S. Patent Application no. 2003/0196580, published in the name of Broderick et al.;

U.S. Pat. No. 5,503,597, issued in the name of Lochtefeld et al.; and

U.S. Pat. No. 5,820,472, issued in the name of Briggs.

Consequently, a need has been felt for mobile, modular water slide apparatus. This application presents claims and embodiments that fulfill a need or needs not yet satisfied by the products, inventions and methods previously or presently available. In particular, the claims and embodiments disclosed herein describe a mobile, modular water slide apparatus comprising a major slide structure; a minor slide structure; a transportable unit, the transportable unit integrated with the major slide structure and the minor slide structure; a plurality of water jet nozzles; a water supply and storage tank, the water supply and storage tank includes a pump; a water catch basin; a water drainage pump; a plurality of anchor columns; and at least one circular, spiral, or winding staircase, the mobile, modular water slide apparatus providing unanticipated and nonobvious combination of features distinguished from the products, inventions and methods preexisting in the art. The applicant is unaware of any product, method, disclosure or reference that discloses the features of the claims and embodiments disclosed herein.

SUMMARY OF THE INVENTION

Briefly described according to one embodiment of the present invention, a mobile, modular water slide apparatus integrated with a mobile or transportable unit, such as a flatbed trailer, is disclosed. The mobile, modular water slide apparatus comprises a major slide structure and a minor slide structure, the major slide structure and minor slide structure having a ride surface. The major slide structure defines a sloped configuration comprising a plurality of modular segments each having a semi-circular or arcuate shape, the modular segments are joined by a coupling device providing a water-tight connection therebetween. The major slide structure includes an elevated entrance section and extends longitudinally therefrom into a least one looped interval which extends integrally to and joins a forward end of the minor slide structure.

The minor slide structure slopes downward from the major slide structure. The minor slide structure comprises a plurality of modular segments each having a semi-circular or arcuate shape, the modular segments of minor slide structure are joined by the coupling device providing a water-tight connection therebetween. The modular segments of the major slide structure and the minor slide structure are constructed of a lightweight, rigid, and corrosion resistant material.

A plurality of water jet nozzles are disposed spatially about the major and minor slide structures via couplings outfitted with fittings for receiving plumbing connections and other accessories. The water jet nozzles are in fluid communication with an external water supply source and storage tank for emitting a predetermined volume of water onto the ride surface. The water supply source includes a pump (not shown) for pumping water from the water supply source to the plurality of water jet nozzles.

A water catch basin for collecting water is provided at the lower end of the minor slide structure. As water collects in the water catch basin, the water is drawn by a pump via conduit and delivered to the water storage tank via conduit.

A plurality of anchor columns is provided for securely supporting and statically stabilizing the major slide structure in an elevational, sloped orientation atop the transportable unit.

In accordance to one embodiment, the plurality of anchor columns may be hydraulically operable, wherein such anchor columns being selectively adaptable along vertical paths for lifting and lowering the anchor columns as needed.

The apparatus of the present invention further comprises at least one circular, spiral, or otherwise winding staircase for gaining access to the elevated entrance section of the major slide structure.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

Detailed Description of the Figures

Figure 1:
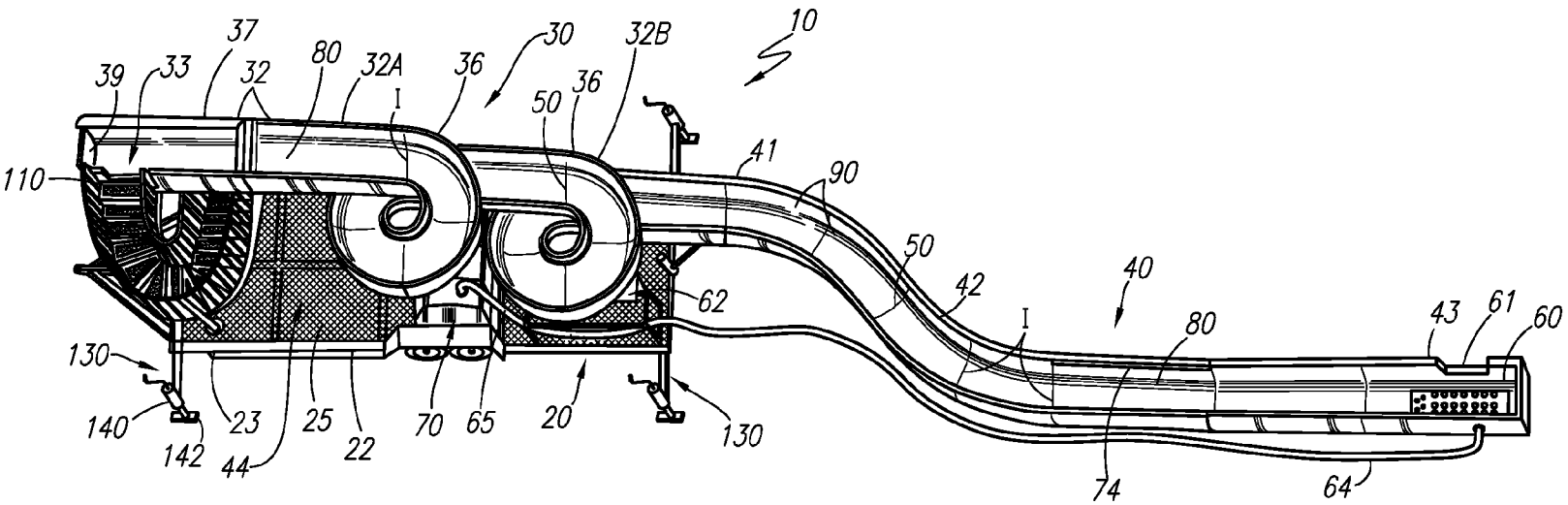
FIG. 1 is a top perspective view of a mobile, modular water slide apparatus, according to one embodiment of the present invention.
Figure 2:
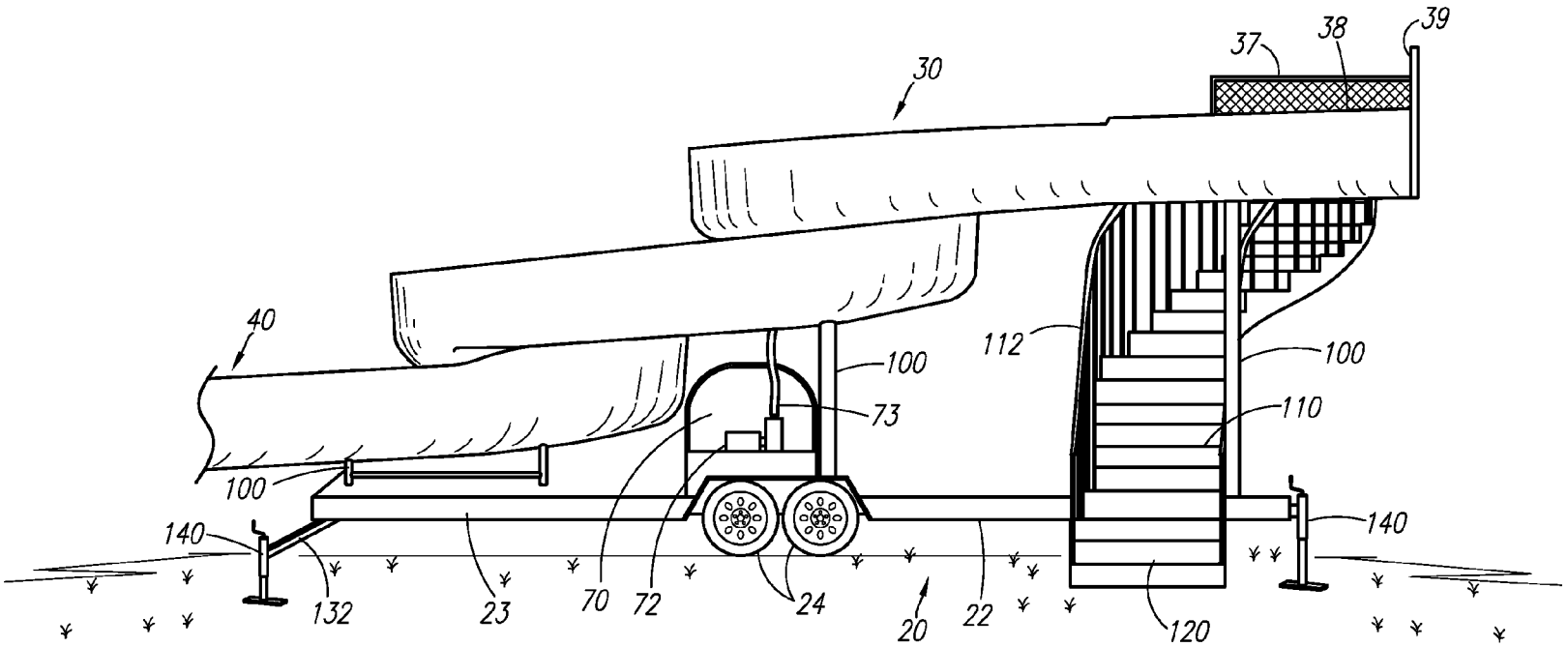
FIG. 2 is a side perspective view of the apparatus of FIG. 1.
Figure 3:
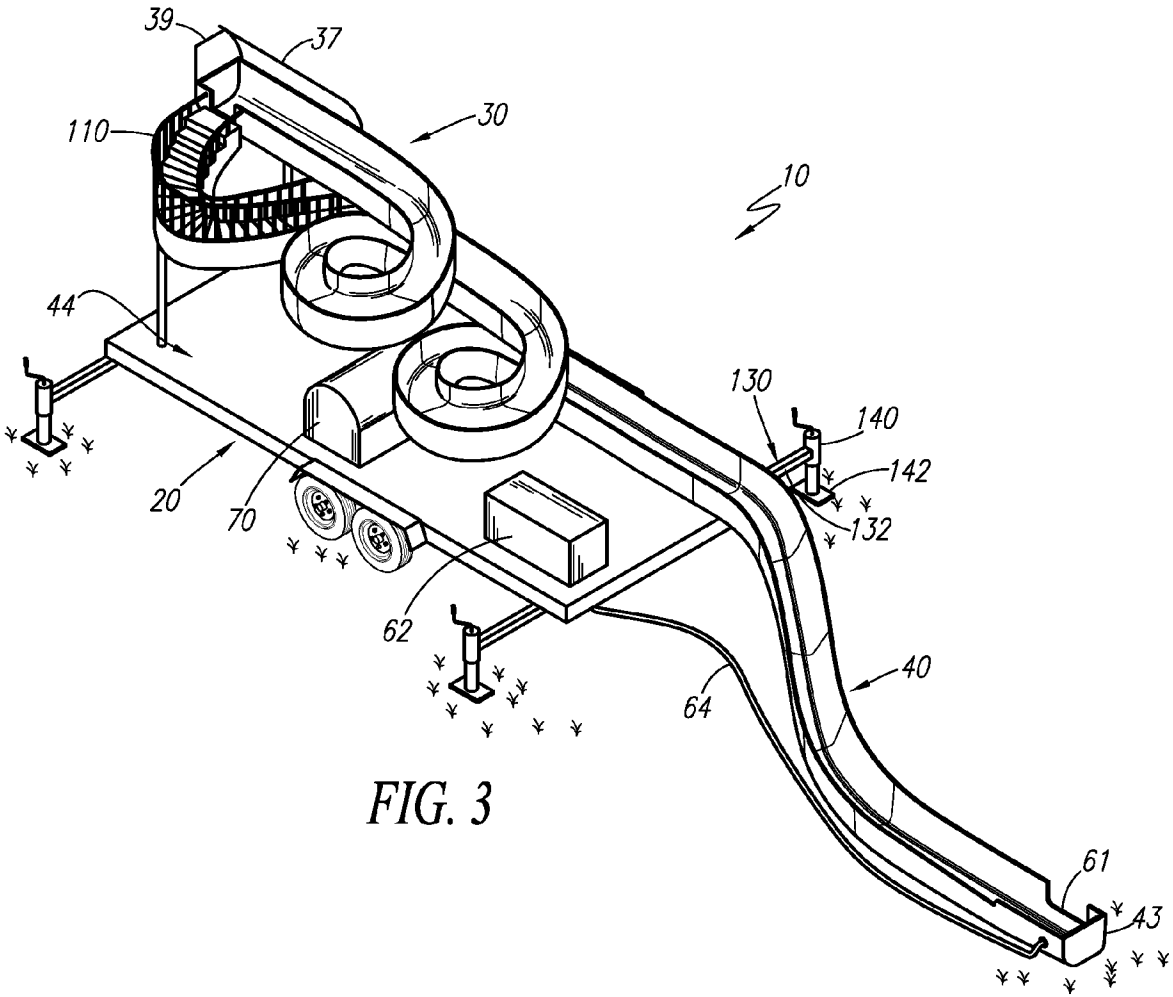
FIG. 3 is a perspective view of the apparatus of FIG. 1.

Referring now to FIGS. 1, 2 and 3, a mobile, modular water slide apparatus 10 is shown, according to one embodiment of the present invention. The mobile, modular water slide apparatus 10, hereinafter "apparatus 10", is constructed onto a mobile or transportable trailer or unit 20. The apparatus 10 comprises a major slide structure 30 and a minor slide structure 40, the major slide structure 30 and the minor slide structure 40 having a ride surface 80. The major slide structure 30 defines a sloped configuration comprising a plurality of modular segments 32 each having a semi-circular or arcuate cross-sectional profile. The modular segments 32 are joined by a coupling device 50 providing a water-tight connection between the segments 32. A number of the modular segments 32 further having a straight or linear shape 32A, and a number of the modular segments 32 having a curved shape 32B to provide apparatus 10 with turns and loops. The major slide structure 30 includes an elevated entrance section 33 and extends longitudinally therefrom into a least one looped interval 36, the at least one looped interval 36 extending integrally to and joining a forward end 41 of the minor slide structure 40. Preferably, the major slide structure 30 includes two looped intervals 36, as best shown in FIG. 1. The major slide structure 30 is attached or coupled to the transportable unit 20.

The major slide structure 30 further includes a safety fence 37 and a gate 39. Safety fence 37 is attached by a hinge 38 to the top portion of the uppermost modular segment 32. Safety fence 37 can be pivoted between a lowered position covering modular segment 32 for transportation and a raised position shown in FIG. 2 for use. Gate 39 is attached to the end of the uppermost modular segment 32. Safety fence 37 and gate 39 assist in ensuring that users remain within modular segment 32 during use.

The minor slide structure 40 slopes downward from and is attached to the major slide structure 30. In one embodiment, the minor slide structure 40 can further have at least one portion or section that is attached or coupled to the transportable unit 20.

The minor slide structure 40 comprises a plurality of modular segments 42 each having a semi-circular or arcuate cross-sectional profile. The modular segments 42 are joined by the coupling device 50 providing a water-tight connection between the segments 42. A number of the modular segments 42 further having a straight or linear shape, and a number of modular segments 42 having a curved shape.

In accordance with one embodiment, the modular segments 42 arcuate profile allows for the segments 42 to be readily stackable to facilitate transportation. The stacked modular segments 42 may be positioned on transportable unit 20 in a stacking space 44 and suitably secured via a securing means to transportable unit 20.

Being modular, the major and minor slide structures 30 and 40 are configurable to a variety of shapes and geometric configurations for integration with a transportable unit 20. The configuration of the apparatus 10 of the present invention as illustrated in FIGS. 1-3 is one preferred embodiment, but many other embodiments comprising different shapes and configurations are envisioned and within the scope and spirit of the present invention.

The modular segments 32 and 42 are constructed of a lightweight, rigid, and corrosion resistant material. The construction material may be selected from the group which includes, but is not limited to plastic, thermoplastic, metal or a metallic-plastic composite. Preferred plastic or thermoplastic materials include polyvinyl chloride (PVC), polypropylene, polyolefin, acrylonitrile-butadiene-styrene (ABS), polyethylene, polyurethane, polycarbonate, or blends thereof, ABS/Nylon blend, and a fiber reinforced polymer, such as fiberglass, and the like. In the event plastic is the selected construction material, modular segments 32 and 42 may fabricated utilizing a common molding process such as injection molding, blow molding, extrusion, or other molding and fabricating methods.

The ride surface 80 may be coated with a polymer material such as Teflon, latex, polyurethane, or fluorinated polymers, and the like, to enhance slipperiness and non-friction thereof.

The coupling device 50, which provides a water-tight connection between the modular segments 32 and 42, may comprise rubber gaskets, couplings, fasteners and other fittings as may be necessary to facilitate a watertight seal between the modular segments 32 and 42. The coupling device 50, once installed, provides a smooth upper surface connection at each segment 32, 42 connection point, or interface I, thereby providing apparatus 10 with a continuous, frictionless, unitary ride surface 80. Further, underpinning brackets may also be provided for imparting constant pressure onto the coupling device 50 so as to further enhance the watertight seal between the modular segments 32 and 42.

A plurality of water jet nozzles 90 are disposed spatially about and along the major and minor slide structure 30 and 40 via couplings outfitted with fittings for receiving plumbing connections and other accessories. Water passages 74 are defined within modular segments 32 and 42 to convey the water to the water jet nozzles 90. The water jet nozzles 90 are in fluid communication with storage tank 70 for emitting a predetermined volume of water onto the ride surface 80. An external water supply source is used to provide water to storage tank 70.

A motor and supply pump 72 is mounted adjacent or to storage tank 70. A pipe or hose 73 is used for pumping water from water supply source 70 to the plurality of water jet nozzles 90. Pipe or hose 73 is connected between pump 72 and water passages 74 in modular segments 32, 42. As water is pumped from the pump 72 through hose 73 and through water passages 74 in modular segments 32, 42 to the jet nozzles 90, water is emitted therefrom and onto the ride surface 80, the water travels from the elevated entrance section 33 downward, under the influence of gravity, to the lower end 43 of the minor slide structure 40.

A water catch basin 60 for collecting water is provided at the lower end 43 of the minor slide structure 40. As water collects in water catch basin 60, the water is drawn by another motor and drainage pump 62 via a hose or conduit 64 and delivered to the water storage tank 70 through another hose 65. An exit opening 61 is formed as recess in the circumferential sidewall of the lowest modular segment 42 of minor slide structure 40. Exit opening 61 allows for a user to readily exit the end of minor slide 40.

A plurality of anchor columns 100 are provided for securely supporting and statically stabilizing the major slide structure 30 in an elevational, sloped orientation atop transportable unit 20, as best illustrated in FIG. 2. Anchor columns 100 may also be utilized for securely supporting and statically stabilizing the minor slide structure 40. The plurality of anchor columns 100 comprises a variety of heights. The anchor columns 100 are each effectively secured to the bed of the transportable unit 20 using bolts or other suitable mounting means and/or methods.

In accordance to one embodiment, the plurality of anchor columns 100 may be hydraulically operable, wherein such anchor columns 100 being selectively adaptable along vertical paths for lifting and lowering the anchor columns 100 as needed.

The apparatus 10 of the present invention further comprises at least one circular, spiral, or otherwise winding staircase 110 for gaining access to the elevated entrance section 33. The staircase 110 includes a side railing 112. The staircase 110 is effectively secured at a bottom end thereof to the bed of a transportable unit 20 using bolts or other suitable mounting means and/or methods. Anchor columns 100 are also utilized for securely supporting and statically stabilizing the staircase 110. An upper end of staircase 110 is contiguously, removably affixed to a lower recess formed by an open space in the circumferential sidewall of the leading modular segment 32 of major slide structure 30, wherein the open space in the circumferential sidewall being previously described and illustrated herein as the elevated entrance section 33.

In accordance to one embodiment, the staircase 110 is envisioned to be modular in design, thereby being readily configurable to a selected major slide structure 30 design in a manner so as to provide optimal functionality and safety.

A supplemental stair structure 120 formed of a plurality of preformed steps constructed of wear-resistant plastic or composite material, or other rigid material capable of being injection molded in units of one or more steps is provided. The supplemental stair structure 120 is positioned adjacent or proximal to the bottom end of staircase 110, or is otherwise removably affixed to the transportable unit 20 in a position adjacent or proximal to the bottom end of staircase 110.

As previously disclosed, another feature and advantage to the apparatus 10 is the adaptability of the apparatus 10 for configuration onto a mobile or transportable unit 20. It is envisioned that such unit 20 comprises a trailer 22 having a frame 23, a grated, webbed, or meshed flat bed 25, and wheels 24. The transportable unit 20 may comprise any of a variety of single or multi-axle motor vehicle or semi-trailer hauled beds, including a flatbed, an extendable flatbed, a drop deck and double drop deck (extendable), a low boy, a tank trailer, a dolly trailer, a trunnion axle trailer, a platform trailer, and other similarly suitable hauling trailers capable of supporting such an apparatus 10 as described above.

The trailer 22 further comprises a stabilization means 130, the stabilization means 130 comprises a plurality of pivoting members 132 hingedly mounted to an underside of trailer 22, the pivoting members 132 each having outer ends mounted with an adjustable anchoring jack 140 to provide the apparatus 10 with horizontal and longitudinal stabilization. Each jack 140 is provided with a foot 142 for supporting the jack 140 on a selected site. The pivoting members 130 are adapted to pivot outward perpendicularly from trailer 22 when anchoring the apparatus 10 of the present invention to a selected site. The pivoting members 130 are further adapted to pivot inward adjacent or below trailer 22 for compact travel. The pivoting members 130 may be detachably affixed at a distal end thereof to trailer 22 via an adjustable locking fastener in order to secure pivoting members 130 during transport.

Once integrated with the transportable unit 20, the major slide structure 30 may be transported via unit 20 in an assembled configuration, thereby facilitating quick, easy, and efficient set-up and use of the apparatus 10 at a desired location. After use of the apparatus 10 at a particular site has been exhausted, the above-described feature and advantage further allows the apparatus 10 to be quickly, easily, and efficiently transported to any number of other desired locations.

Figure 4:
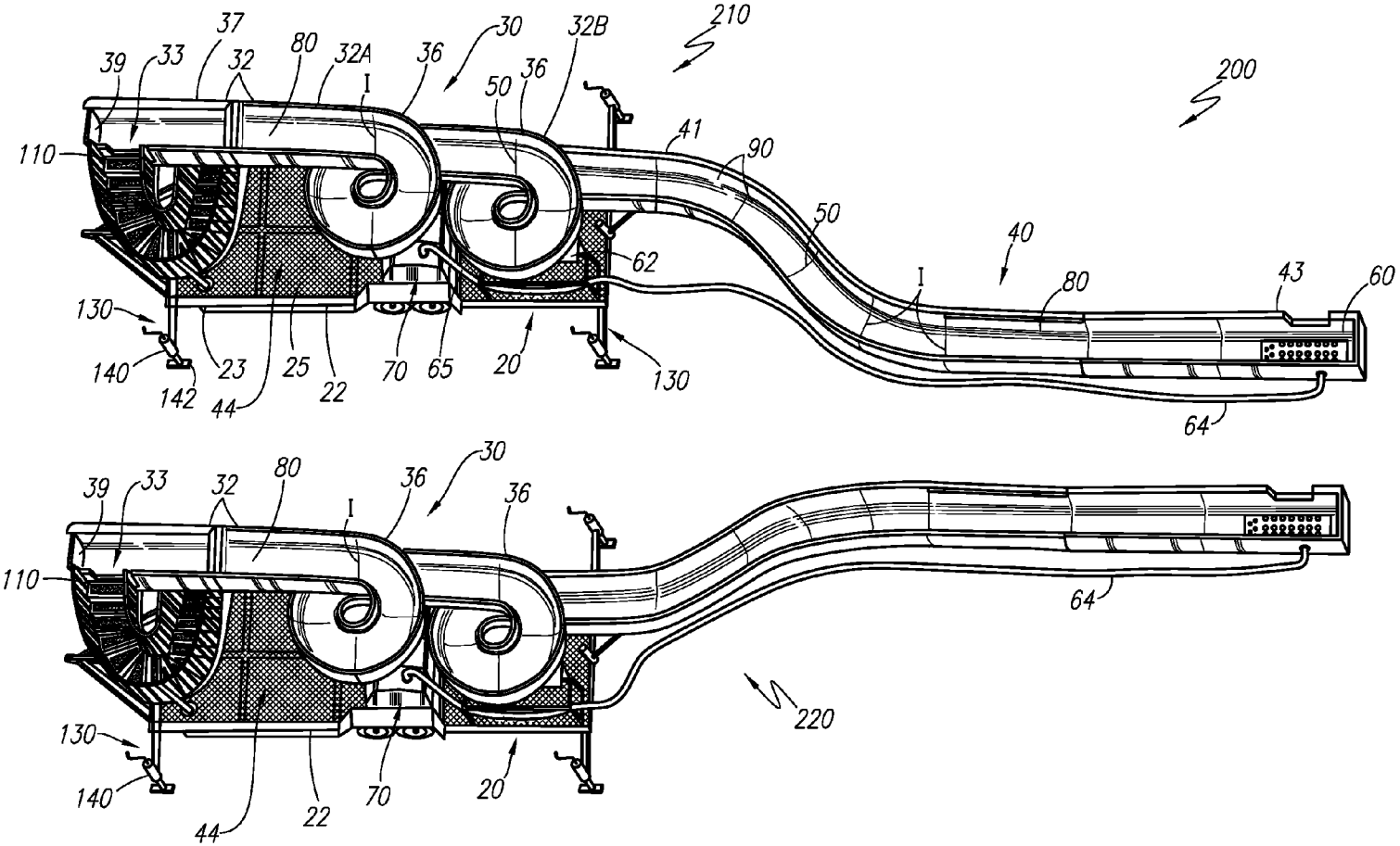
FIG. 4 is a top perspective view of a side by side race track version of a mobile, modular water slide apparatus, according to another embodiment of the present invention.
Figure 5:
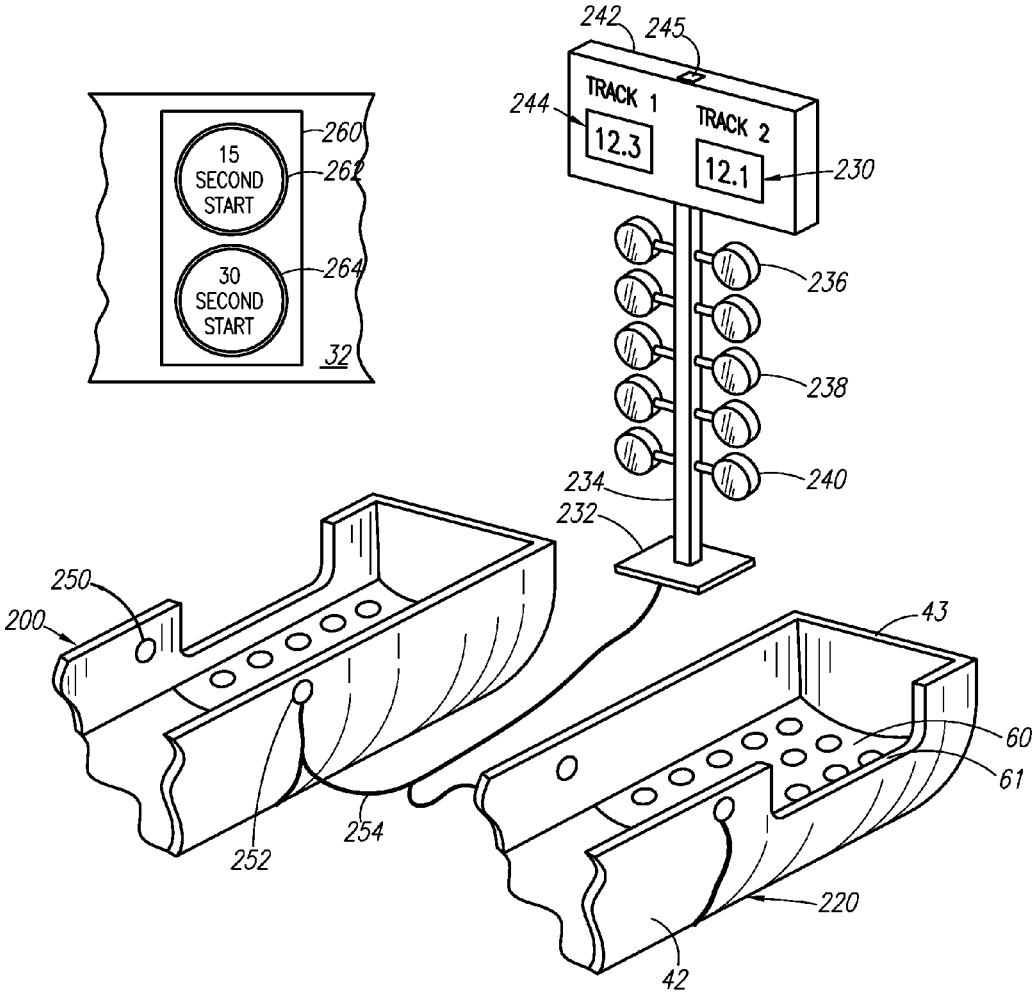
FIG. 5 is a perspective view of a start light and timer assembly used with the apparatus of FIG. 4.

Referring now to FIGS. 4 and 5, another embodiment of a race track water slide apparatus 200 is shown. Race track water slide apparatus 200 comprises two of the mobile, modular water slide apparatuses 10 of FIG. 1-3, hereinafter labeled apparatus 210 and 220, respectively. Apparatus 210 and 220 are the same as previously disclosed for apparatus 10. Apparatus 210 and 220 are positioned on a selected site in a side by side configuration such that the respective major slide structures 30 and minor slide structures 40 of each of apparatus 210 and 220 are generally parallel.

Race track water slide apparatus 200 allows two participants to race against each other to see either who reaches the lower end 43 of minor slide 40 first or who has the fastest elapsed ride time to traverse both major slide 30 and minor slide 40. Race track water slide apparatus 200 includes a starting light and display assembly 230. Starting light and display assembly 230 includes a base 232 to which a pole 234 is mounted. Starting light and display assembly 230 can also be referred to as a "Christmas tree", in accordance to conventional drag racing vernacular.

Several lights are mounted to pole 234 including one or more red lights 236, one or more yellow lights 238 and one or more green lights 240. Lights 236, 238 and 240 can be illuminated in sequence in order to signal to the race participants to begin the race. The red lights 236 are first illuminated, then the yellow lights 238 and finally the green lights 240 are illuminated signaling the start of the race.

A display 242 is mounted to the end of pole 234. Display 242 can contain a timer 245 and one or more digital readouts 244 that indicate the time for a race participant to complete the race along slides 30 and 40 from the top of entrance 33 to the lower end 43. Display 242 contains a controller and is in communication with lights 236-240 and can control the operation of lights 236-240. An infrared source 250 and an infrared detector 252 are mounted in an opposed spaced apart relationship on opposite sides of the lower most modular segment 42 toward lower end 43. Infrared source 250 and detector 252 are electrically connected to display 242 by wires 254. Alternatively, infrared source 250 and detector 252 can be in wireless communication with display 242 through wireless communication means.

A control panel 260 is mounted to a sidewall of one or more of the upper most modular segments 32 adjacent to entrance 33. Control panel 260 is in communication with display 242 either through a wire or through wireless communication means. Control panel 260 has one or more control buttons 262, 264 that allow a race participant to begin a race on race track water slide apparatus 200. The depression of control button 262, signals to display 242 to begin the race in 15 seconds. The depression of control button 264, signals to display 242 to begin the race in 30 seconds. After one of control buttons 262, 264 has been depressed, display 242 resets digital readouts 244, initiates infrared source 250 and detector 252 and begins the illumination sequence of lights 236-240. At the same time as green light 240 is illuminated, the timer in display 244 is started and the elapsed time displayed on digital readouts 244. Eventually, the race participants will interrupt the infrared signal between source 250 and detector 252 causing display 244 to stop the timer and the digital readouts 244 to display the elapsed race times for each participant.

In an alternative embodiment, the starting light and display assembly 230 can be used with the single modular water slide apparatus 10 of FIGS. 1-3 in order to provide a single water slide user an elapsed travel time.

Figure 6:
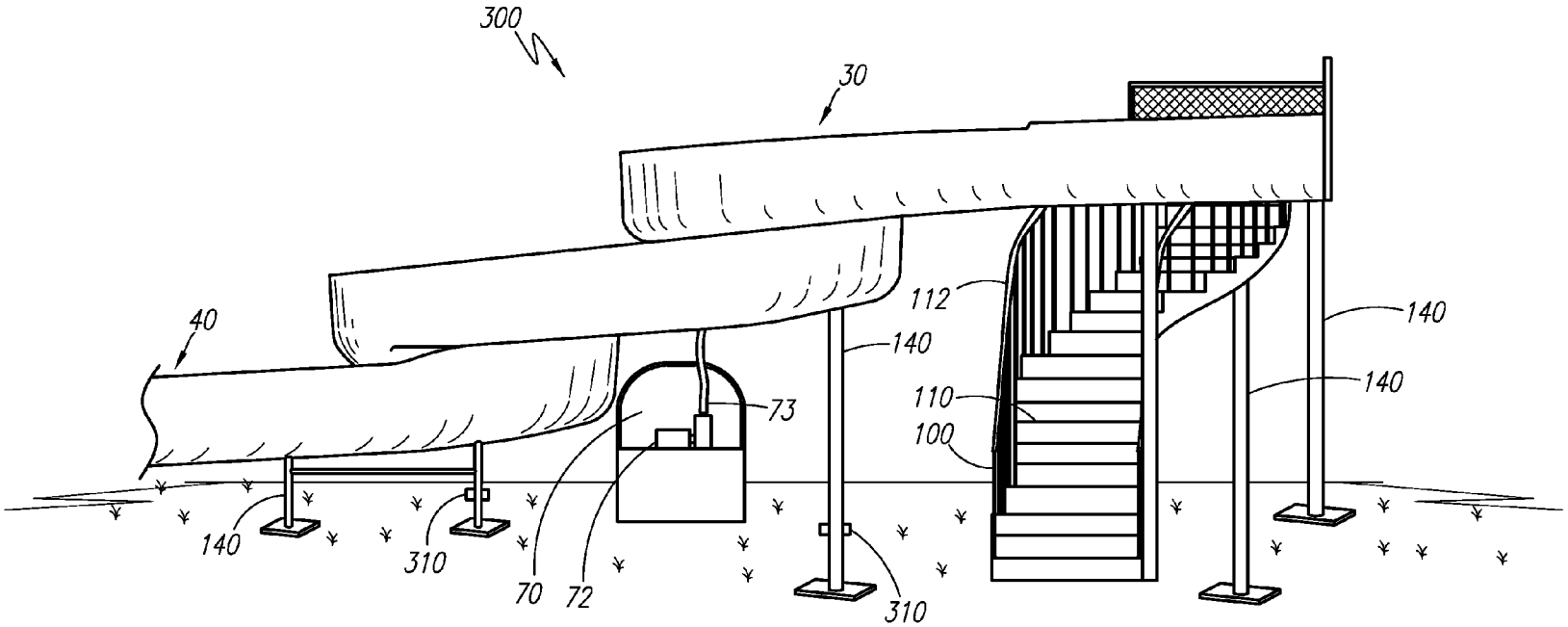
FIG. 6 is a side perspective view of a mobile, modular water slide apparatus in an anchored position with the transportable unit removed according to an additional embodiment of the present invention.

FIG. 6 illustrates another embodiment of a mobile, modular water slide apparatus 300 according to an additional embodiment of the present invention. Modular water slide apparatus 300 is similar to water slide apparatus 10 of FIGS.

1-3. Modular water slide apparatus 300 is capable of being detached from transportable unit 20 (FIG. 2) and positioned in a static free standing anchored position. Modular water slide apparatus 300 includes attachment features 310 that allow modular water slide apparatus 300 be attached with and detached from transportable unit 20. When the modular water slide apparatus 300 is detached from transportable unit 20, the adjustable anchoring jacks 140 support major slide 30 and minor slide 40 in an elevated position above the ground. Anchoring jacks 140 are positioned prior to the removal of transportable unit 20. Storage tank 70 and pump 62 can be placed on the ground during operation of modular water slide apparatus 300.

It is envisioned that the various embodiments, as separately disclosed, are interchangeable in various aspects, so that elements of one embodiment may be incorporated into one or more of the other embodiments, and that specific positioning of individual elements may necessitate other arrangements not specifically disclosed to accommodate performance requirements or spatial considerations.

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

What is claimed is:

1. A mobile, modular water slide apparatus comprising:
- a major slide structure;
- a minor slide structure;
- a transportable unit, the transportable unit integrated with the major slide structure and the minor slide structure;
- a water supply means for providing water to the major and minor slides, the water supply means including a supply pump;
- a water catch basin, the water catch basin provided at a lower end of the minor slide structure; and
- a plurality of anchor columns securely supporting and statically stabilizing the major slide structure in an elevational, sloped orientation atop the transportable unit.

2. The apparatus of claim 1, further comprising a water catch basin, the water catch basin provided at a lower end of the minor slide structure at least one circular, spiral, or winding staircase.

3. The apparatus of claim 2, further comprising a drainage pump for drawing water from the water catch basin.

4. The apparatus of claim 1, further comprising a plurality of water jet nozzles disposed spatially about the major slide structure and the minor slide structure.

5. The apparatus of claim 1, further comprising a plurality of anchor columns for securely supporting and statically stabilizing the major slide structure in an elevational, sloped orientation atop the transportable unit wherein the plurality of anchor columns is selectively adaptable along vertical paths for lifting and lowering the plurality of anchor columns.

6. The apparatus of claim 1, further comprising wherein the at least one circular, spiral, or winding staircase includes an upper end and a lower end, the upper end of the staircase is contiguously, removably affixed to the major slide structure, and the bottom end of the staircase is effectively secured to a bed portion of the transportable unit.

7. The apparatus of claim 1, wherein the transportable unit comprises a stabilization means.

8. A mobile, modular water slide apparatus comprising:
- a transportable unit, the transportable unit adapted to be moved;
- a first slide structure coupled to the transportable unit;
- a second detachable slide structure coupled to the first slide structure, the second detachable slide structure having a plurality of second modular segments; and
- a water pump and storage tank coupled to the transportable unit.

9. The apparatus of claim 8, further comprising a water catch basin, the water catch basin provided at a lower end of the second slide structure.

10. The apparatus of claim 8, wherein the first slide structure has a plurality of first modular segments.

11. The apparatus of claim 8, further comprising a coupling bracket for coupling two of the second modular segments together.

12. The apparatus of claim 8 further comprising a safety fence coupled to the first slide structure.

13. The apparatus of claim 8, further comprising a gate coupled to an end of the first slide structure.

14. The apparatus of claim 8, wherein the transportable unit further includes a stacking space for storage of the second modular segments.

15. A mobile, modular water slide apparatus comprising:
- a major slide structure;
- a minor slide structure coupled to the major slide structure, the major slide structure and the minor slide structure defining a continuous ride surface;
- a transportable unit, the transportable unit coupled to and integrated with the major slide structure and the minor slide structure;
- a storage tank coupled to the transportable unit for storing water; and
- a water pump in fluid communication with the storage tank, the water pump adapted to pump water from the storage tank to the major and minor slide structures.

16. The apparatus of claim 15, further comprising two or more of the mobile modular water slide apparatuses positioned side by side.

17. The apparatus of claim 15, further comprising a control panel mounted to the major slide for starting a timer.

18. The apparatus of claim 15, further comprising a light assembly positioned adjacent an end of the minor slide.

19. The apparatus of claim 15 further comprising a display for showing at least one elapsed ride time.

20. The apparatus of claim 15 further comprising an infrared source and detector mounted to the minor slide and in communication with the display.

* * * * *